US006854204B2

(12) United States Patent
Uden

(10) Patent No.: US 6,854,204 B2
(45) Date of Patent: Feb. 15, 2005

(54) DEVICE FOR DISPLAYING INFORMATION

(76) Inventor: Bertil Uden, P.O. Box 10156, Stockholm (SE), SE-10055

( * ) Notice: Subject to any disclaimer, the term of this patent is extended or adjusted under 35 U.S.C. 154(b) by 0 days.

(21) Appl. No.: 10/343,741

(22) PCT Filed: Aug. 2, 2001

(86) PCT No.: PCT/SE01/01702

§ 371 (c)(1),
(2), (4) Date: Feb. 6, 2003

(87) PCT Pub. No.: WO02/13172

PCT Pub. Date: Feb. 14, 2002

(65) Prior Publication Data

US 2003/0167671 A1 Sep. 11, 2003

(30) Foreign Application Priority Data

Aug. 7, 2000 (SE) ..... 0002836

(51) Int. Cl.[7] ..... G09F 17/00

(52) U.S. Cl. ..... 40/603; 40/607.03; 40/607.04; 40/611.11; 40/742

(58) Field of Search ..... 40/603, 604, 606.14, 40/607.03, 607.04, 611.11, 611.12, 607.14, 742; 160/378; 403/200

(56) References Cited

U.S. PATENT DOCUMENTS

| | | | | | |
|---|---|---|---|---|---|
| 1,842,274 | A | * | 1/1932 | Landwehr et al. | 40/603 |
| 1,974,076 | A | * | 9/1934 | Lindenberger | 40/603 |
| 2,072,754 | A | * | 3/1937 | Jones | 40/603 |
| 4,959,916 | A | * | 10/1990 | Cochrane | 40/603 |
| 5,467,546 | A | * | 11/1995 | Kovalak, Jr. | 40/603 |
| 6,367,224 | B1 | * | 4/2002 | Leek | 52/704 |

FOREIGN PATENT DOCUMENTS

| | | |
|---|---|---|
| DE | 29821407 U1 | 4/1999 |
| DE | 19850267 A1 | 12/1999 |
| DE | 20003418 U1 | 11/2000 |
| FR | 2676572 | 11/1992 |

OTHER PUBLICATIONS

Derwent's Abstract No. 1999–050369, Week 199905, Abstract of JP 10301517A (Sentoku KK), Nov. 13, 1998.

Derwent's Abstract No. 1997–091279, Week 199709, Abstract of JP 8328499A (Kawaguchi Kumi YG), Dec. 13, 1996.

* cited by examiner

*Primary Examiner*—Mark T. Le
(74) *Attorney, Agent, or Firm*—Jacobson Holman PLLC

(57) ABSTRACT

A device for displaying information in particular, but no exclusively, including an upper horizontal stand section and a lower horizontal stand section spaced vertically from the upper horizontal stand section, a vertically extending rod which is preferably adjustable in the direction of its longitudinal axis and the other end of which is connected to the lower horizontal stand sections, wherein the stand sections form an upper and a lower limitation for a preferably flexible information carrier tensioned there between. Included in the respective upper and lower horizontal stand sections are mutually identical profiled elements which are constructed on at least one long side for releasably accommodating mutually opposite ends of the preferably flexible information carriers, wherein respective profiled elements are detachably connected to respective upper and lower parts of the vertical rod.

5 Claims, 5 Drawing Sheets

DEVICE FOR DISPLAYING INFORMATION

This is a nationalization of PCT/SE01/01702 filed Aug. 2, 2001 and published in English.

The present invention relates to a device intended particularly, but not exclusively, for displaying information and comprising an upper horizontal stand part and a lower horizontal stand part spaced vertically from said upper horizontal stand part and a vertical rod or bar which can preferably be adjusted in the direction of its longitudinal axis and the upper end of which is connected to the upper horizontal stand part and the lower end of which is connected to the lower horizontal stand part. The stand parts define an upper and a lower limitation for an information carrier, or screen, which is preferably flexible and stretched between said upper and lower limitation. The upper and the lower horizontal stand parts include mutually identical profile elements which are designed to releasably accommodate mutually opposing ends of the preferably flexible screen on at least one long side, wherein respective profile elements are detachably connected to the upper and the lower parts of the vertical rod or bar.

DESCRIPTION OF THE BACKGROUND ART

A number of information carriers of the general kind and described above are known commercially. For example, the generally known device used to display diapositive slides has a sign which is the reverse of that of a window shade or blind, i.e. the information carrier, or screen, is rolled up on a spring-loaded shaft and placed in a casing. The screen is intended to be drawn up out of the casing and fastened to the upper end of an outwardly foldable, vertical stand section.

An information carrier of the kind described in the introduction is known from DE 38 50 267 A1 for example.

The present invention takes as its starting point the type of information carrier device described in the introduction and the object of the invention is to provide such a device in which its components can be assembled quickly and readily to form a media screen that can be used to communicate information both outdoors and indoors, in shops, stores, showrooms, exhibition rooms and the like. Another object of the invention is to provide means for constructing a partition wall in exhibition rooms or showrooms or being used as a decoration, for instance by dividing the room into segregated areas.

A further object of the invention is to provide a product that can be produced more readily and more cheaply than known devices of this kind.

Still another object of the invention is to provide a device that will enable the information carrier to be used flexibly, said information carrier, or screen, being combined with means which enables it to be mounted on a horizontal supportive surface and/or which can be hung on a wall.

Yet another object of the invention is to provide means which enable a double information carrier to be obtained, by enabling information to be displayed from mutually opposite directions.

Still another object of the invention is to provide a vertical rod or bar such that an information carrier fastened between two mutually spaced profiled elements will be automatically stretched in the device.

BRIEF DESCRIPTION OF THE DRAWINGS

The invention will now be described in more detail with reference to exemplifying embodiments thereof and also with reference to the accompanying drawings, in which.

DEATAILED DESCRIPTION OF THE PREFERRED EMBODIMENTS

Figure 1:
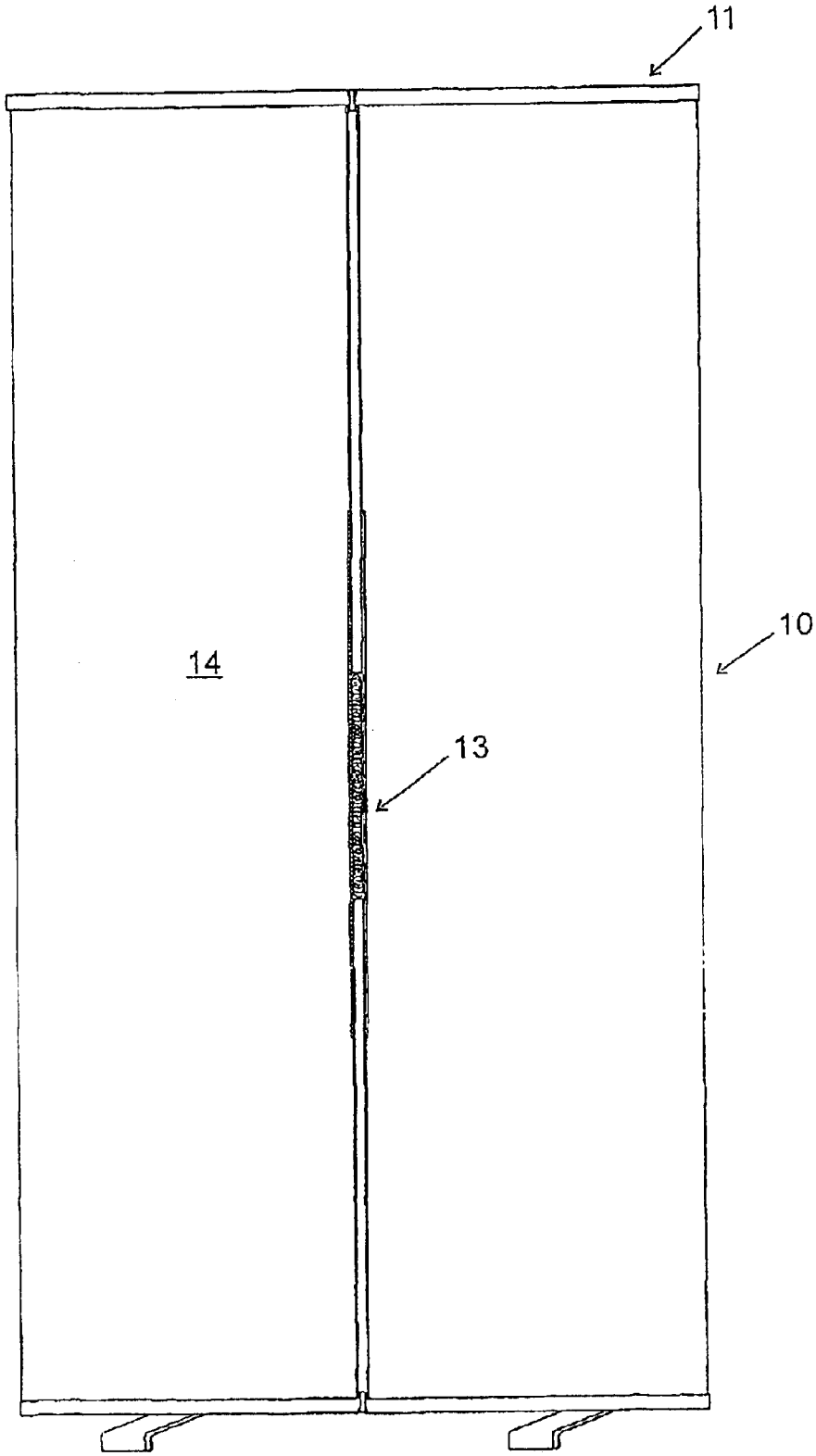
FIG. 1 is a front view, partly in section, of the inventive device.

The inventive device is generally referenced 10 in FIG. 1 and includes in general an upper horizontal and elongate stand section 11, a lower and elongate stand section 12 spaced from the upper stand section 11, and a vertical rod 13 whose upper end is detachably connected to the upper horizontal stand section 11 and whose lower end is detachably connected to the lower horizontal stand section 12. These two stand sections 11 and 12 form respectively an upper and a lower limit for an information carrier 14, or screen, which is detachably stretched between the upper and the lower stand sections 11 and 12 and the width of which is essentially the same as the length of said stand sections.

The information carrier 14 is rectangular in shape and preferably flexible, and may be made of paper, board, plastic or cloth.

As will be seen from FIG. 1, the vertical rod 13 is formed from a centrally disposed tube 13' that houses a compression spring 15 that is fixed approximately in the midway region of the tube 13' by means of a pin 16 that passes through said tube, therewith enabling the length of the vertical rod 13 to be adjusted. An upper, second tube 13" is inserted into the upper end of the tube 13' with a slight clearance between said tubes, with the bottom end of said upper tube lying against the upper end of the spring 15. Correspondingly, a third tube 13'" is inserted into the bottom of the tube 13' with a slight clearance between said tubes, with the top end of said third tube lying against the bottom end of the spring 15. In the illustrated case, the length of respective upper and lower tubes 13" and 13'" is greater than the length of the intermediate tube 13', although it will be understood that all tubes may have one and the same length. Depending on the length of the spring 15 and on the dimensions concerned, the length of the rod 13 can be varied from a maximum upper length position with the spring uncompressed to a maximum lower and shorter position with the spring 15 compressed from both sides, i.e. by the upper and lower tubes 13" and 13'".

Figure 3:
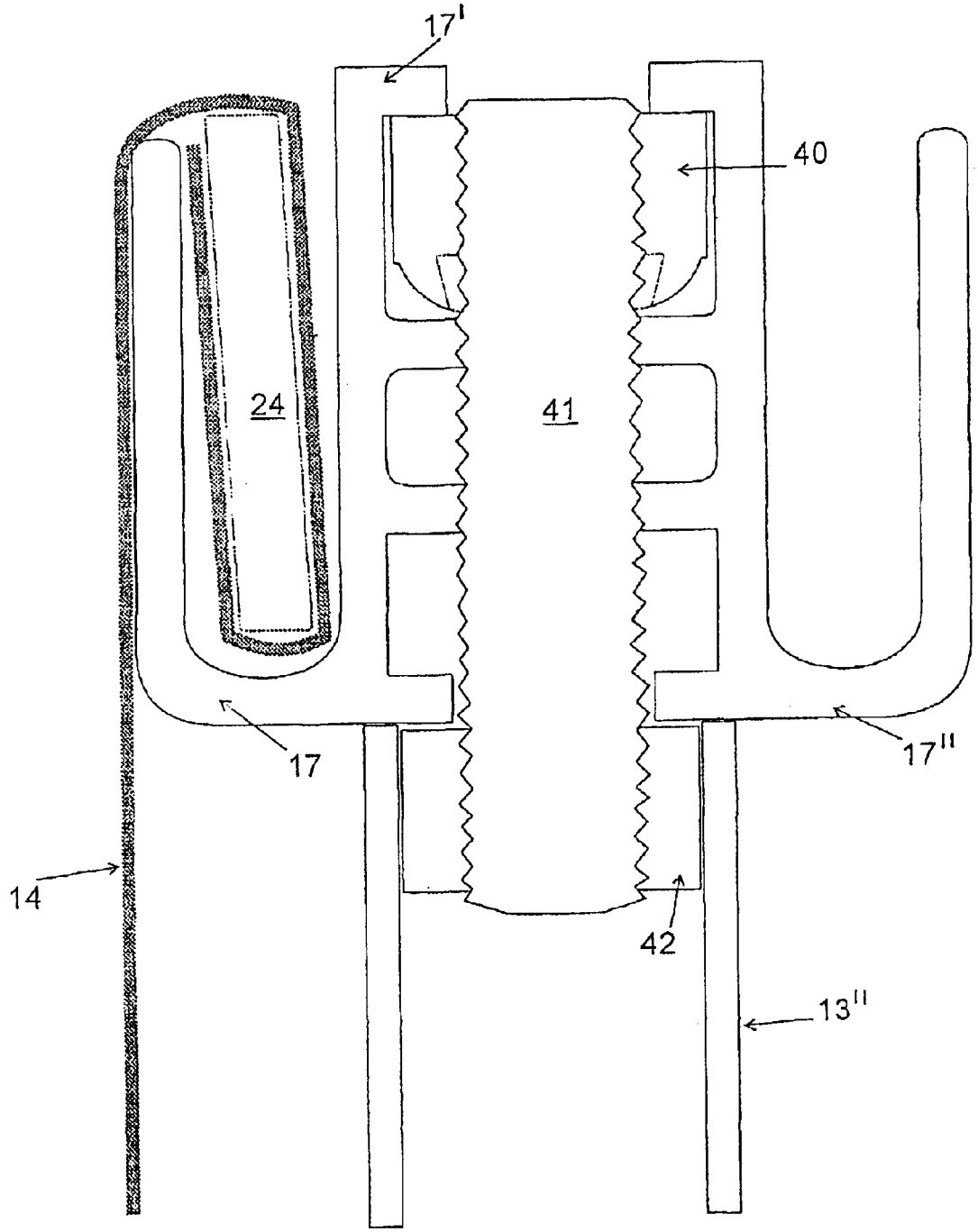
FIG. 3 illustrates in larger scale a first embodiment of the upper profiled element, said upper and lower profiled elements being of identical construction.

FIG. 3 is a cross-sectional view of a first embodiment of the two mutually identical upper and lower stand sections 11, 12. The figure is a larger-scale illustration of the upper stand part 11 and its releasable connection to the upper part 13" of the rod 13, and shows a first embodiment for releasably fastening the upper end of the information carrier or screen 14. It will also be seen from the figure that the upper stand section 11 (and thus also the other stand section 12) comprises a profiled element which includes a U-shaped part 17 which merges with a central part 17', and preferably also a further U-shaped part 17". In this embodiment, the information carrier 14 includes a rigid strip 24 which extends across the full width of the information carrier. The information carrier 14 is fastened by inserting the upper end of the information carrier, stiffened by the strip 24, between the two legs of the U-shaped profiled element. Correspondingly, the bottom end of the information carrier 14 is inserted into the recess formed by the legs of the U-shaped part of the lower profiled element 12, said U-shaped part being in reverse to the first mentioned U-shaped part, and said lower end of the information carrier 14 being stiffened by a further strip 24.

Figure 4:
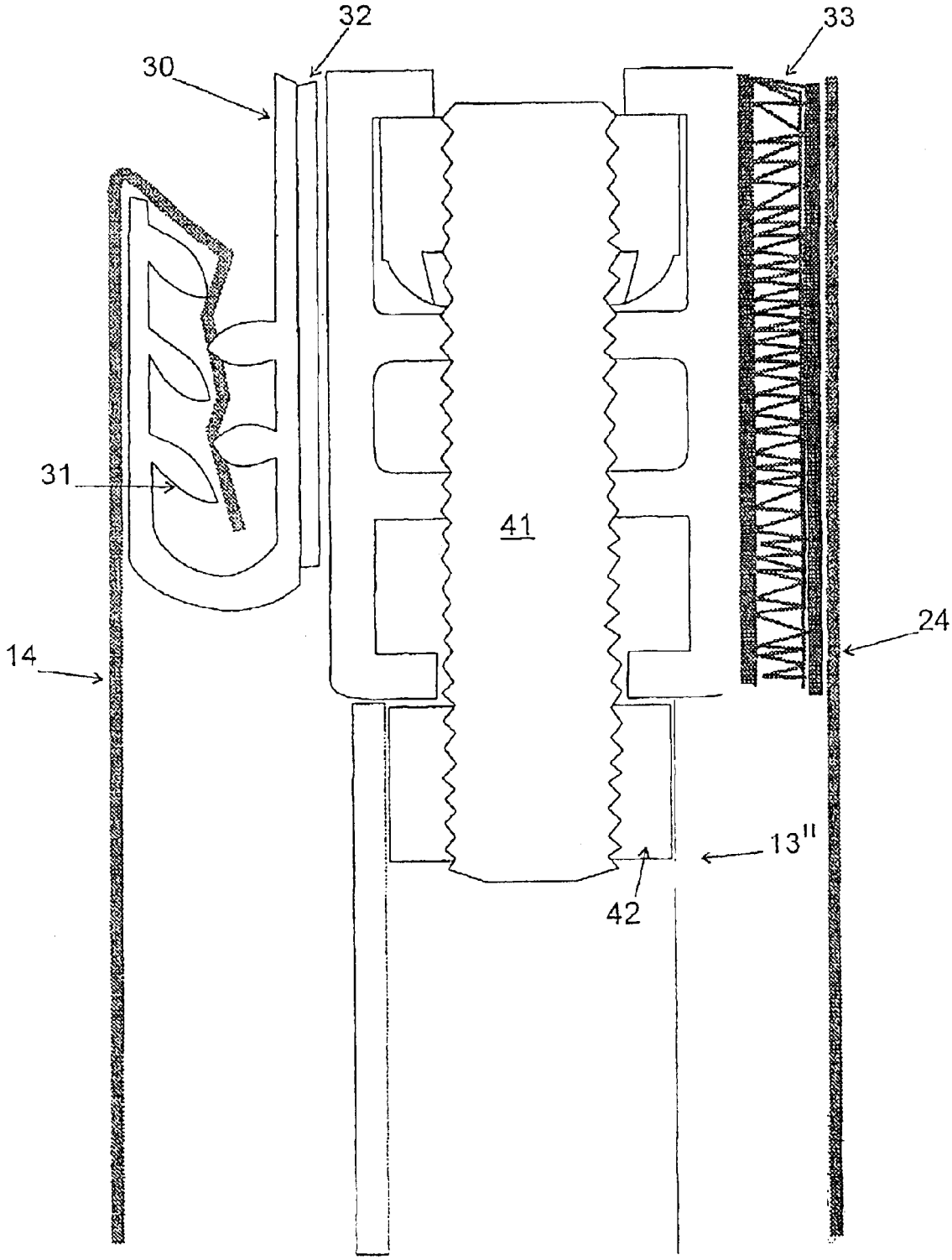
FIG. 4 illustrates in larger scale a second embodiment and a third embodiment respectively of the upper profiled element.

FIG. 4 illustrates a second embodiment of an upper and a lower profiled element 11, 12 for the detachable attachment of an information carrier 14, and a vertical rod 13. Shown to the left of the figure is a U-shaped part, e.g. made of a plastic material, referenced 30, wherein the aperture between the legs has resilient and mutually opposed oblique tongues 31 between which the end of an information carrier 14 is inserted. This arrangement forms a known type of friction lock. The U-shaped plastic part 30 can be detachably fastened against the central part 17' of the profiled element, by means of adhesive tape for example—as indicated at 32.

As shown schematically in FIG. 4, the right-hand part of an information carrier 14 can also be detachably fastened against the central part 17' of the profiled element in a manner known per se. In the illustrated case it is assumed that the information carrier is fastened by means of a touch-and-close fastener, indicated at 33, although it will be understood that an adhesive tape may well be used instead.

Figure 5:
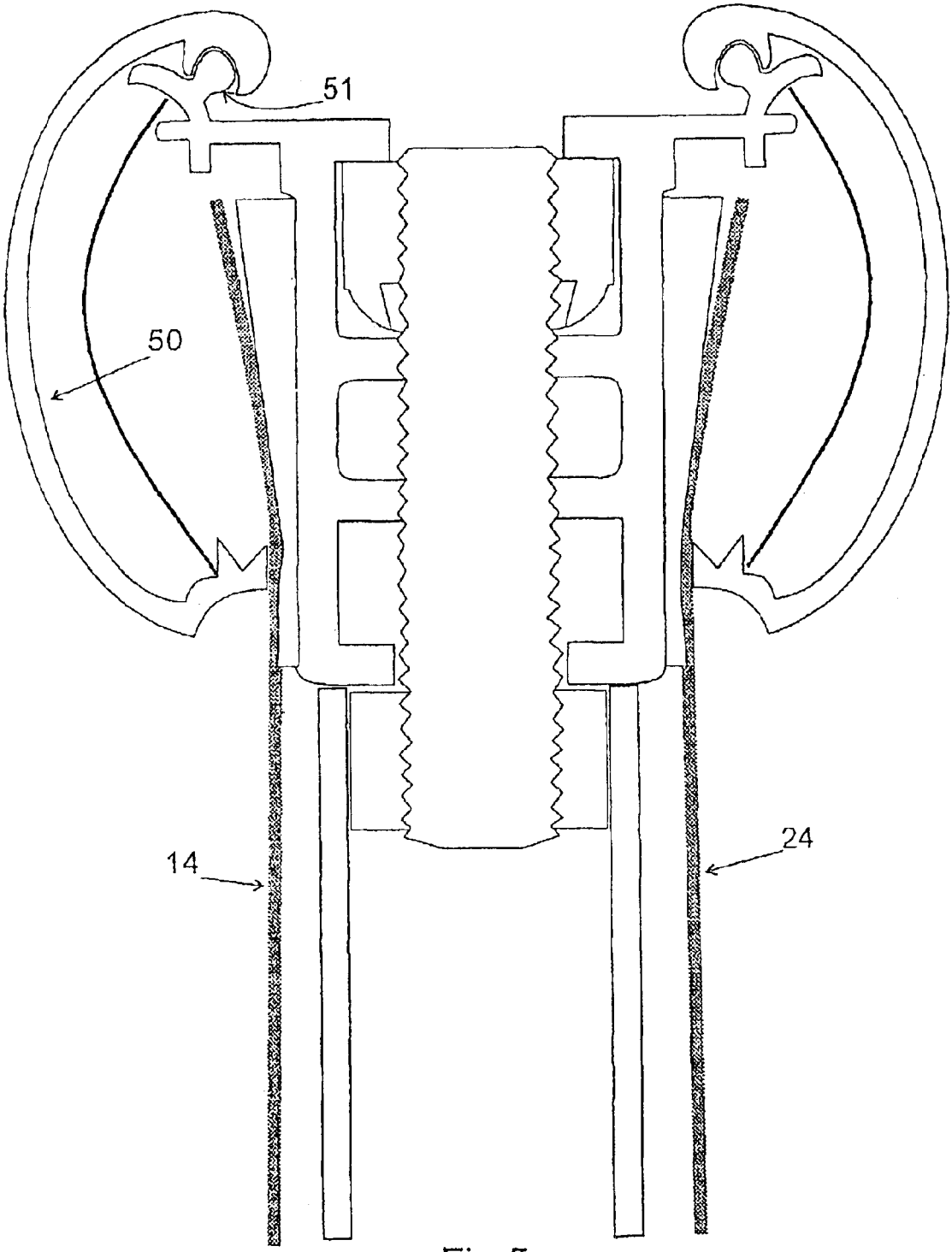
FIG. 5 illustrates a fourth embodiment of a profiled element, in larger scale.

FIG. 5 illustrates an embodiment of the profiled elements 11 and 12 in which the elements 11, 12 include on at least one side thereof a known type of snap-arm 50 whose upper end is hinged about a hinge point 51 and the lower end of which lies against and grips firmly the respectively upper and lower ends of the information carrier 14, with a predetermined force. The snap-arm 50 will, of course extend over the full width of the information carrier 14.

As will be understood from the aforegoing, respective upper and lower profiled elements 11, 12 can be formed in different ways with respect to securing the information carrier 14 to the stand, and that respective profiled elements may conveniently be constructed so as to enable two information carriers 14 that face in different directions to be mounted on the stand.

Figure 2:
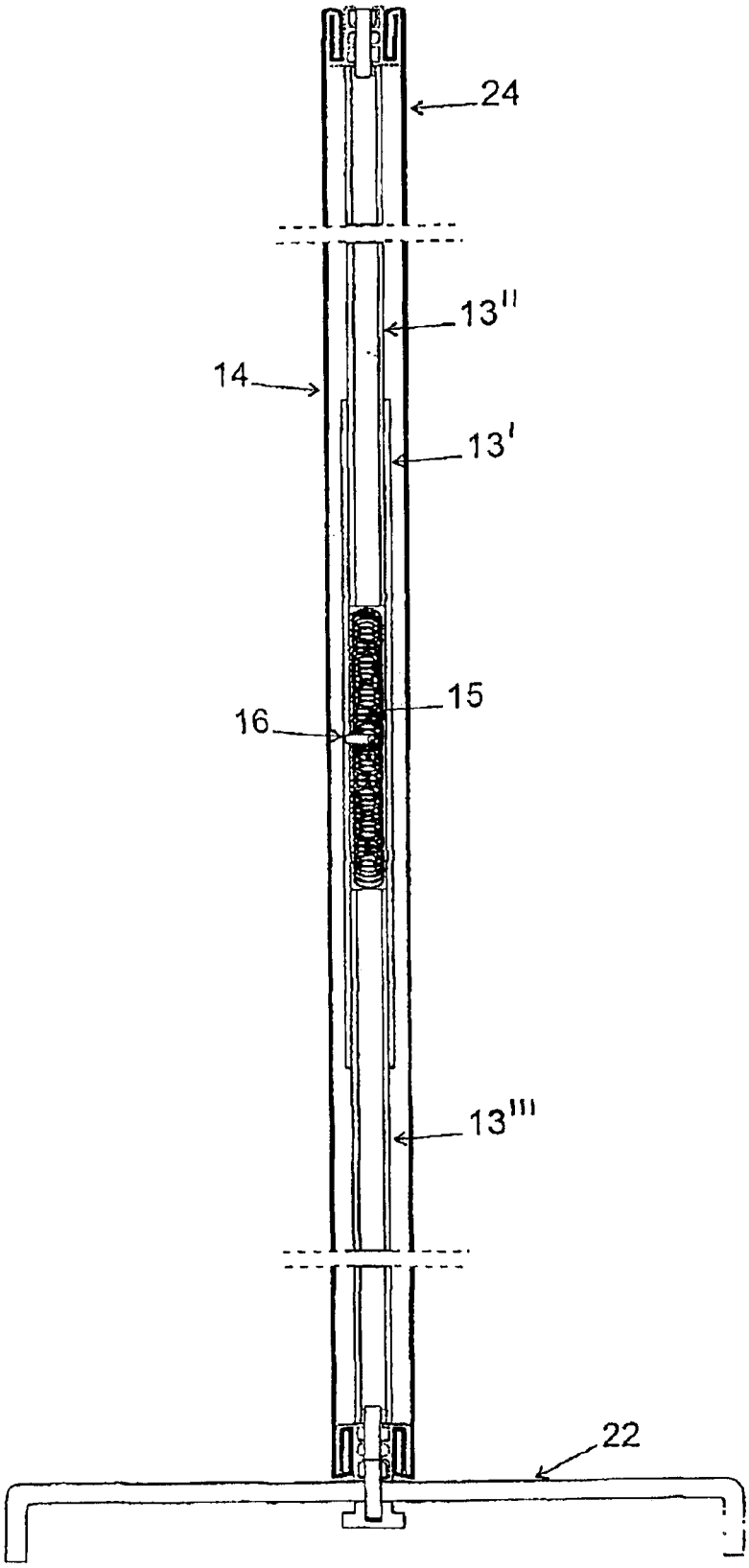
FIG. 2 is a cross-sectional view of upper and lower profiled elements, and of the vertical rod or bar.

The construction of the rod 13, as illustrated in FIG. 2, provides the important advantage of holding the information carrier (carriers) 14 (24) tensioned in its/their position of use between the profiled elements 11, 12 by the outwardly acting and downwardly acting force of the spring 15 on the tube part 13" and tube part 13'". respectively, regardless of the construction of said profiled elements. No subsequent adjustment is necessary. The extent to which the information carrier 14 is tensioned or stretched in its position of use is determined by the strength of the spring 15.

Regardless of the construction chosen for the detachable fastening of the information carrier 14, the cross-sectional central part 17' of respective profiled elements includes in its centremost region a stationary, perforated element 40 that includes internal threads for co-action with an externally threaded bolt 41 that extends vertically through the central part of respective profiled elements 11 and 12 and projects beyond said elements. This will be seen best from FIGS. 3, 4 and 5. Because respective upper and lower ends of the vertical rod 13 includes internal threads or, alternatively, has a fixed threaded nut 42 in the region of respective upper and lower ends of the rod 13, said nut 42 being intended for co-action with the threaded bolt 41 in respective profiled elements, said elements 11, 12 can be detachably connected to the vertical rod 13.

In this way, the upper profiled element 11 is connected to the upper part of the rod 13, while the lower profiled element 12 is connected to the lower end of the rod 13. Finally, the information carrier or carriers 14, 24 is/are tensioned between the upper and lower profiled elements in one of the ways described above. The device can be assembled in less than one minute.

The preferred spring-loaded embodiment of the vertical rod 13 may be replaced with a telescopic arrangement that will provide a rod of variable length, although this substitution will not provide the automatic tensioning of the information carrier 14 afforded by the arrangement shown in FIG. 2.

It is essential within the scope of this invention to provide an upper and a lower profiled element which are mutually identical and which enable the releasable attachment of both the vertical rod 13 and at least one information carrier 14.

In one preferred embodiment, respective profiled elements 11, 12 are made of aluminium.

Finally, the lower profiled element 12 will include means for releasable attachment of support legs 22. These means may be identical with the means used for releasable connection between respective profiled elements 11, 12 and respective upper and lower ends of the rod, as indicated in the bottom part of FIG. 2.

What is claimed is:

1. A device for displaying information, said device comprising an upper, horizontal stand section and a lower horizontal stand section spaced vertically from said upper stand section, a vertically extending rod, the rod being adjustable and an upper end of the rod being connected to the upper horizontal stand section and a lower end of the rod being connected to the lower horizontal stand section, the stand sections forming an upper and a lower limitation for a flexible information carrier tensioned therebetween, the respective upper and lower horizontal stand sections including identical profiled elements constructed on at least one long side for releasably receiving opposing ends of the flexible information carrier, the respective profiled elements being releasably connected to respective upper and lower parts of the vertical rod and forming part of the upper and lower stand sections, respectively, the vertical rod including a first tubular element provided internally with a fixedly mounted element having spring properties, and second and third tubular elements inserted into the first tubular element from respective opposite ends thereof and extending with one end in abutment with the spring element and respective other ends being attached releasably to the respective upper and lower horizontal stand sections, the stand sections and the vertical rod being arranged between two flexible information carriers.

2. The device according to claim 1, wherein the respective horizontal stand sections have a form of the respective profiled elements which include outer parts which have a U-shaped cross section and which flank a central part, wherein mutually opposite ends of the information carrier lie between legs of respective U-shaped parts.

3. The device according to claim 2, wherein the mutually opposite ends of the information carrier are provided with a stiffening strip which is accommodated between the legs of the respective U-shaped parts.

4. The device according to claim 1, wherein the respective profiled elements have a vertically extending externally threaded bolt for co-action with a corresponding thread in the respective upper and lower tubular ends of the rod, wherein the respective upper and lower tubular ends of the vertical rod have a stationary, internally threaded nut for co-action with the vertical bolt of the respective profiled elements.

5. The device according to claim 1, wherein an automatic adjustability of the vertical rod in a direction of its longitudinal axis is dependent on dimensioning of the spring element.

* * * * *